United States Patent [19]

Lippka et al.

[11] Patent Number: 4,998,313

[45] Date of Patent: Mar. 12, 1991

[54] SELF-ADJUSTING VARIABLE HEIGHT GANGWAY SYSTEM

[75] Inventors: Sandra M. Lippka, Warwick, R.I.; Carl R. Peterson, Boxford, Mass.

[73] Assignee: Massachusetts Institute of Technology, Cambridge, Mass.

[21] Appl. No.: 380,710

[22] Filed: Jul. 13, 1989

Related U.S. Application Data

[63] Continuation of Ser. No. 163,977, Mar. 4, 1988, abandoned.

[51] Int. Cl.[5] ..... E01D 1/00

[52] U.S. Cl. ..... 14/71.1; 14/69.5; 114/263; 182/223

[58] Field of Search ..... 14/1, 69.5, 71.1; 414/139; 114/230, 263; 182/223; 405/219

[56] References Cited

U.S. PATENT DOCUMENTS

| | | | |
|---|---|---|---|
| 1,329,924 | 2/1920 | Paul | 14/71.1 X |
| 3,034,162 | 5/1962 | Smith | 14/2.4 |
| 3,074,241 | 1/1963 | Cahill et al. | 14/71.1 X |
| 3,827,385 | 8/1974 | Soma | 14/71.1 X |
| 4,260,293 | 4/1981 | Peterson | 405/219 |
| 4,517,698 | 5/1985 | Lamp'l et al. | 14/69.5 X |
| 4,581,784 | 4/1986 | Rousseau et al. | 14/71.1 |

*Primary Examiner*—Bruce M. Kisliuk
*Attorney, Agent, or Firm*—Robert F. O'Connell

[57] ABSTRACT

A gangway system for providing access, particularly for handicapped persons, between structures having surfaces which are relatively movable with respect to each other over a range of motion. The gangway includes a plurality of alternating ramp and platform members hingedly coupled to one another, the ends of the gangway being in contact with the surfaces of the structures. The platform members are supported by support members fixed in position relative to one of the structures and, over the range of motion, as the surfaces move vertically relative to one another the ramps and platforms come to rest in sequence adjacent the surface of the other structure. The lengths of the ramps are selected to be less than a preselected value and their slopes are selected so as not to exceed a preselected value during use so that handicapped access is facilitated.

8 Claims, 2 Drawing Sheets

SELF-ADJUSTING VARIABLE HEIGHT GANGWAY SYSTEM

Figure 1:
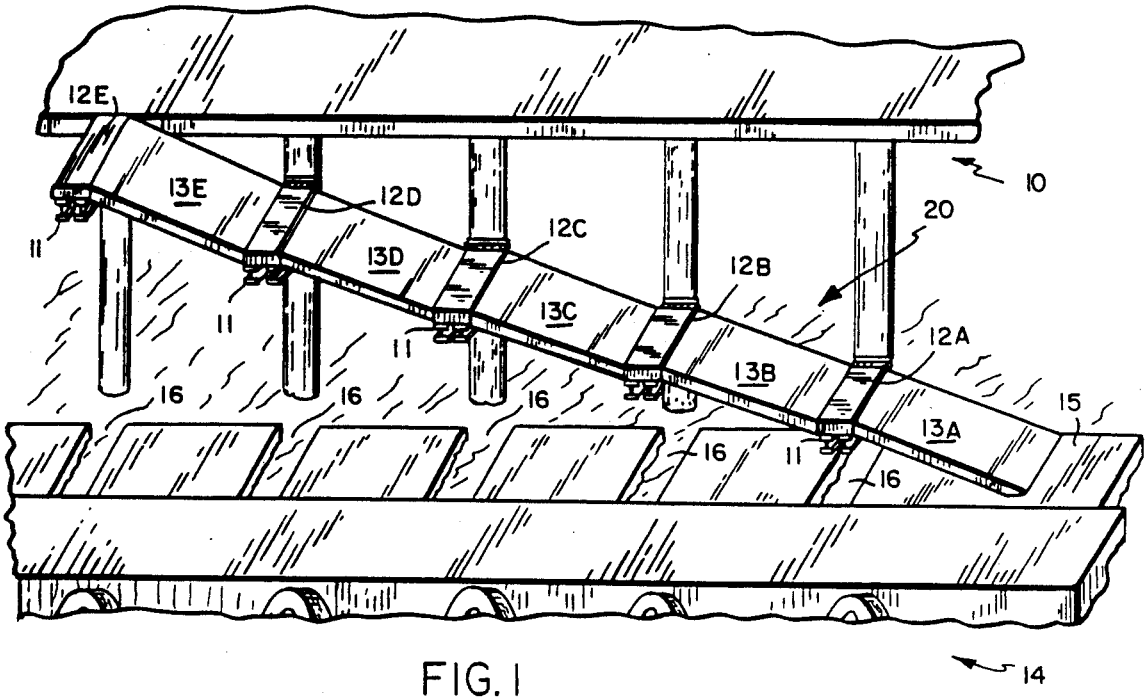

This is a continuation of copending application Ser. No. 07/163,977 filed on Mar. 4, 1988 now abandoned.

INTRODUCTION

This invention relates generally to systems for use in providing access between relatively movable surfaces of structures and, more particularly, to gangway systems for providing access for handicapped persons between a fixed structure, such as a stationary pier, and a movable structure, such as a floating dock, which structure moves generally vertically as a result of tidal motions.

BACKGROUND OF THE INVENTION

It is often desirable to provide access for handicapped persons between relatively movable structures. For example, a fixedly mounted pier structure and a movable platform structure, such as a floating dock, often require a provision for access between them by handicapped persons. For such purpose, the access providing means, such as a gangway, must conform to certain governmental regulations relating to handicapped access in that the access ramps during use thereof must have slopes no greater than a specified value and must have lengths no greater than a specified maximum value before being provided with a resting platform.

When such systems are designed, for example, to provide access between a fixed pier and a floating dock, tidal movements over a relatively large range often make the use of a simple, single ramp structure either impractical or impossible for such purpose since such a ramp structure could not in some cases be made to conform to the aforesaid slope and length requirements. Most structures proposed for such purpose are of the elevator type wherein electro-mechanical power driven platforms move between the relatively movable structures. Such techniques are relatively expensive and are subject to maintenance problems during use. It would be desirable to provide an access technique which does not require the use of power driven structures so that cost and maintenance problems can be considerably reduced.

BRIEF SUMMARY OF THE INVENTION

The system of the invention is designed to be able to satisfy both the tidal motion requirements and such codes and regulations as are required for handicapped accessibility, without the use of power driven elevators or the like. In accordance with a particular preferred embodiment thereof, a gangway access system comprises a series of alternating ramp members and platform members, the ends of the ramps generally being hingedly connected to the platforms. A ramp at one extreme end of the gangway system is hingedly connected to a platform which, for example, can be fixedly attached for entry to the surface of the stationary pier structure and a ramp at the other extreme end of the gangway system is arranged so as to rest on an access surface portion of the movable floating dock. The arrangement includes a plurality of fixed support members positioned at selected heights. Such supports lie generally beneath the platform members of the gangway system.

When the tide is at its lowest level, the platforms of the gangway system rest on the supports and access is achieved via the alternating ramps and platforms from the lowest ramp which rests on the floating dock access surface to the highest ramp which is attached to the platform at the pier surface.

In a preferred embodiment, for example, as the tide rises from its lowest to its highest level, the ramps and platforms of the overall system sequentially come to rest on the access surface of the floating dock and rise along with the dock. The ramps sequentially pivot about their hinged ends as they come to rest on the access surface surface of the floating dock and the supports sequentially pass through corresponding recesses, or openings, in such access surface. At high tide, for example, all of the platforms and all, or at least all but one, of the ramps come to rest on the access surface of the floating dock structure and easy access to the pier structure is available. At intermediate tide levels, one or more of the platforms and one or more of the ramps of the gangway lie on the access surface of the floating dock while the remaining one or more ramps and platforms form a shortened gangway between the surface of the floating dock and that of the pier.

Accordingly, in all instances from low to high tide, access is readily achieved and the ramp and platform arrangement conforms to the requirements for handicap access at all times.

DESCRIPTION OF THE INVENTION

Figure 2:
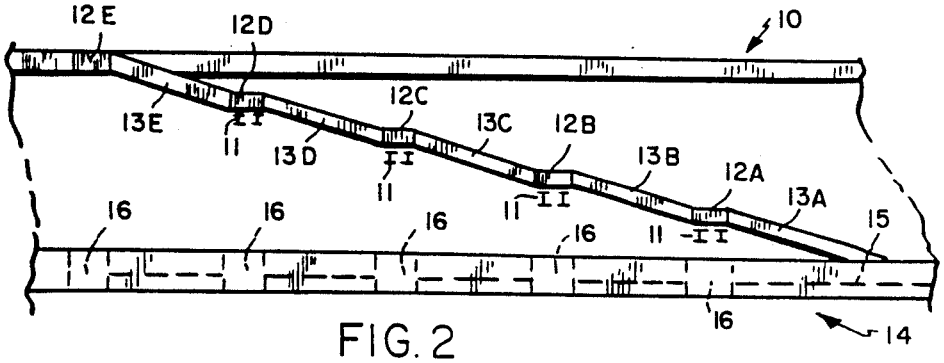
Figure 2A:
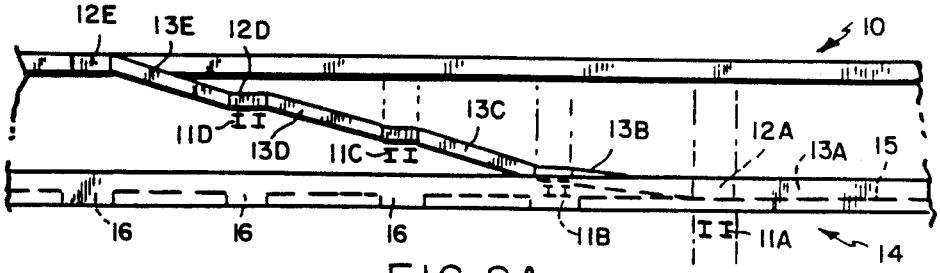
Figure 2B:
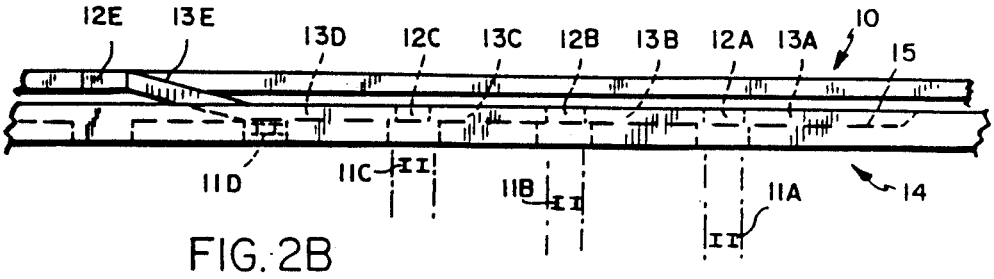
Figures 3, 4:
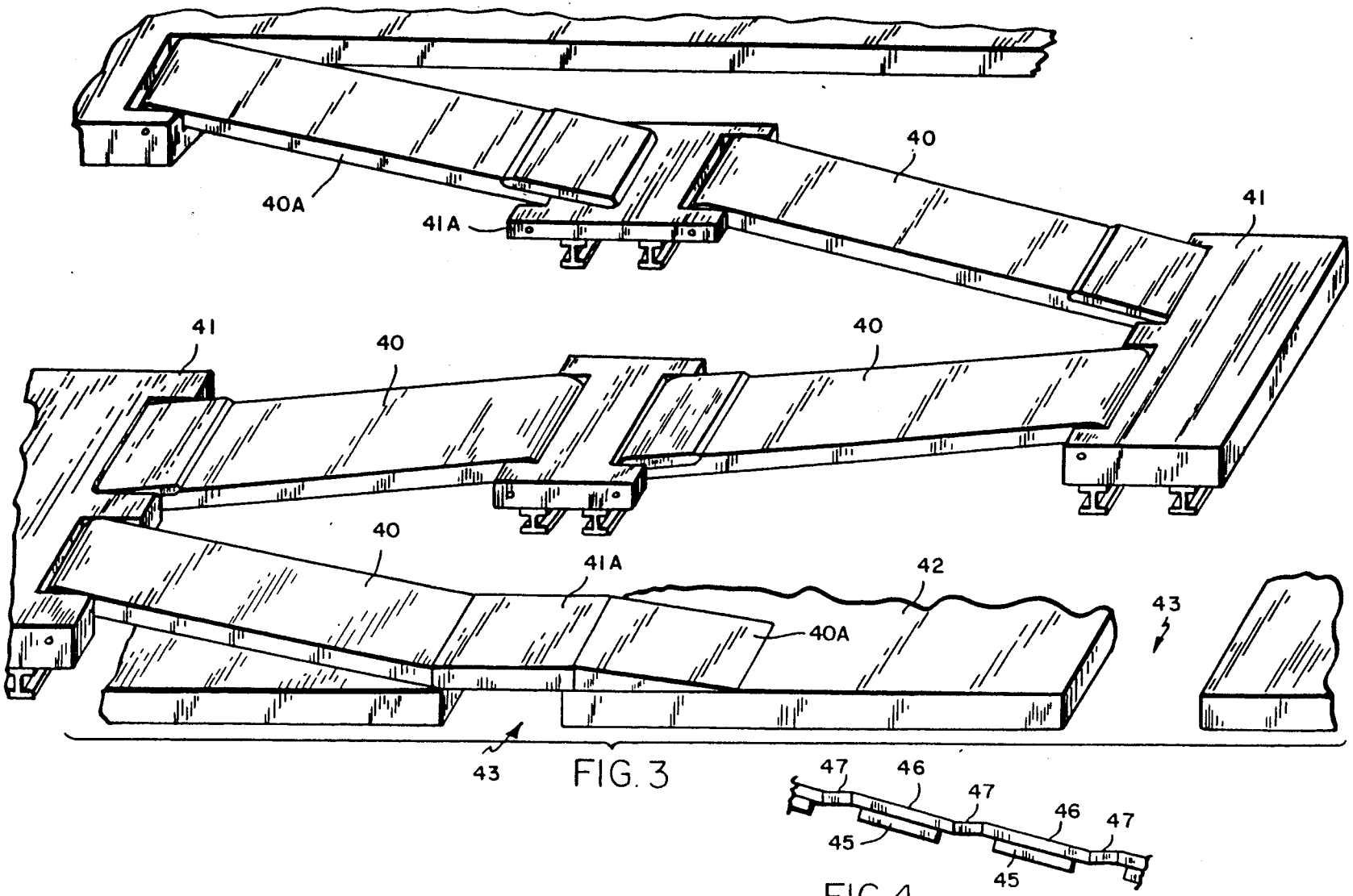

The invention can be described in more detail with the help of the accompanying drawings wherein FIG. 1 shows a view in perspective of one embodiment of a gangway system of the invention;

FIGS. 2, 2A and 2B show diagrammatic views of the gangway system of FIG. 1 at various stages of operation from low to high tide conditions; and FIGS. 3 and 4 show a view in perspective of a portion of an alternative embodiment of the invention.

As can be seen in FIGS. 1, 2, 2A and 2B, a fixed or stationary pier structure 10 has a plurality of fixedly attached support, or I-beam, members 11 projecting outwardly at selected heights therefrom. A gangway 20 comprises a plurality of alternating ramp members 13 hingedly connected at their ends to platform members 12, as shown. In the particular embodiment depicted, a ramp member 13E, at one extreme end of gangway 20, is hingedly attached to a platform member 12E, which in turn is fixedly attached to pier 10 at the surface thereof. A ramp member 13A, at the other extreme end thereof, rests on an access surface 15 associated with a movable, or floating, dock structure 14.

The access surface 15 of floating dock 14 has a plurality of recesses, or openings, 16 formed therein, such recesses being effectively positioned beneath and in line with the I-beam supports 11 so as to permit the supports to pass through the recesses during use of the device as the floating dock structure moves vertically with the tidal motions, as discussed more fully below.

The operation of the overall system can be best understood by considering the diagrammatic views depicted in FIGS. 2, 2A and 2B. FIG. 2 shows the overall system at a low tide. As can be seen in the exemplary embodiment depicted therein, the gangway 20 comprises a series of five ramps 13A through 13E, alternating with platforms 12A through 12E. The upper platform 12E is fixedly attached to the pier 10, while the ramp 13A at the opposite end rests on a portion of the access surface 15 of floating dock structure 14 as shown. Access between the floating dock and the stationary pier is provided by using the series of alternating platforms and ramps 12 and 13, respectively. Each of the platforms 12A, 12B, 12C and 12D is fully supported by one of the I-beam support members 11, so that the overall gangway is generally stable during use.

At such low tide level, it can be seen that the slopes of the ramps are at their maximum values, the number and lengths of such ramps being selected so that in no case do such slopes exceed a desired ratio x/y. Moreover, the lengths of each of the ramps are selected to be no greater than a desired maximum value z.

More specifically, exemplary regulations for handicapped access may require that the slope be no greater than 1/12 and that the length of a ramp between platforms be no greater than 32 feet. The structure shown in FIG. 2 can be readily made in accordance with such regulations by using an appropriately selected number of ramps and platforms which accomodates the greatest specified range of tidal motion. Thus, in a particular example depicted, for a range of tidal motion of 9 feet, from low to high tide, the structure is arranged to have 5 ramps and 5 platforms. Such selection assures that each of the ramp lengths need not be greater than 32 feet and that each of the slopes will never be greater than 1/12 at an tidal height. Similar selections can be made for other tidal motions, and for other regulation requirements.

FIG. 2A depicts the system of the invention at some intermediate tide level, e.g., at a mid-tide level. As can be seen therein, the distance between the pier surface and the access surface 15 of the floating dock 14 is reduced as the tide rises so that, for the exemplary conditions depicted in FIG. 2A, ramp 13A and platform 12A have essentially come to rest on the access surface 15. Beam support member 11A has effectively passed through a corresponding recess of such surface. The remaining platforms 12B, 12C and 12D rest on beam supports 11B, 11C, and 11D, respectively, and ramps 13B, 13C, 13D and 13E remain above surface 15 so as to form a suitable shortened gangway for access from dock 14 to pier 10. Again, all ramp length and slope characteristics lie within the desired regulations for handicapped access. It would be clear that similar conditions exist at any intermediate tide level.

FIG. 2B depicts the overall system at high tide. For the particular embodiment depicted, all of the ramps 13A through 13D, as well as the platforms 12A through 12D, are in substantial alignment and rest on the access surface 15 of floating dock 14. The remaining ramp 13E extends from such surface level to the platform 12E and provides ready access thereto and, hence, to the surface of pier 10 when the tidal motion has reached its maximum height. Support members 11A, 11B and 11C have passed through their corresponding recesses in access surface 15, support member 11D essentially being positioned in, but not having passed through, its corresponding recess. Alternatively, the overall system can be arranged so that at high tide all of the ramps and platforms, including ramps 13E and platform 12E, are in alignment with access surface 15, as well as with the surface of pier 10.

Although the specific embodiment depicted in FIGS. 1, 2, 2A and 2B show the use of I-beam support members attached to the pier structure 10 it is clear that such support means is not limited to such an arrangement. Any arrangement which utilizes support members which are fixed in position relative to the pier structure at predetermined locations, such as at the predetermined heights shown, can be used. For example, such support members need not be attached to the pier structure itself and could be part of a free standing structure which is suitably anchored so as to rest on the bottom surface of the body of water where the overall system is being used.

The design of appropriate hinging arrangements for coupling the ramps at either end to their associated platforms would be well within the skill of those in the art and many suitable hinging arrangements can be devised for such purpose. Hence, such coupling arrangements need not be described in more detail here. The particular embodiment depicted in FIGS. 1, 2, 2A and 2B provides a system in which the ramps and platforms of the gangway extend effectively in a straight line. However, if the pier and dock structures with which they are used are not long enough to accomodate such an overall linear system, the ramps and platforms can be arranged in a substantially folded, or doubled back, manner, as shown in FIG. 3.

As depicted therein, adjacent pairs of ramps 40 are arranged in a side-by-side relationship coupled at their corresponding ends with a perpendicularly arranged platform 41 hingedly coupled thereto and single ramps 40A are hingedly coupled to intermediate platforms 41A at the ends of such arrangement. As the floating dock moves vertically with the tide each pair comes to rest sequentially on an access surface 42 of a dock which surface is wide enough to accommodate all of the ramps and platforms at high tide. The beam supports can again be accomodated in such an arrangement by appropriate recesses 43 in such surface. Thus, the overall structure can provide adequate ramp and platform surfaces for access within the regulations required therefor, but the overall structure is considerably shortened when compared with the straight-line version described above.

Alternatively, should a separate access surface not be provided in either of the embodiments depicted in FIGS. 1 and 3 the ramps and platforms must be supported by some other means as the floating dock moves from its low to high tide conditions. An alternative approach as shown in FIG. 4 would be to use one or more suitable floating support members 45 attached to the lower surfaces of the ramps 46 and platforms 47 so that as the tide rises they effectively come to rest and float in sequence on the water surface adjacent and generally parallel to the surface of the floating dock. In such a structure the need for providing a separate access surface and for providing recesses therein for the support members is avoided and the support means merely pass by the side of the surface of the floating dock.

While the above discussed particular embodiments of the invention represent preferred embodiments thereof, modifications thereto will occur to those in the art within the spirit and scope thereof. Hence, the invention is not to be construed as limited to such embodiments except as defined by the appended claims.

What is claimed is:

1. A system for providing access between a pier structure and a dock structure each having surfaces which are relatively movable with respect to each other over a range of motion determined by a range of tidal motions, said system comprising a plurality of platform members;

a plurality of ramp members hingedly coupled to said platform members so as to form a gangway comprising a series of alternating ones of said platform and ramp members, said gangway being positioned between said pier and dock structures, the ends of the gangway being in contact with said structures;

a plurality of support members fixed in position relative to said pier structure beneath said gangway and positioned at predetermined vertical locations along the length of said pier structure beneath said platform members;

an access surface at said dock structure having a plurality of openings at locations along the length thereof corresponding to the locations of said support members;

means for causing said support members to support one or more of said platform members so that one or more of said ramp and platform members come to rest one said access surface adjacent the surface of said dock structure and one or more of said support members pass through said openings as said pier and dock structures move relative to one another over range of tidal motion.

2. A system in accordance with claim 1 wherein said causing means includes float members attached to said ramp and platform members so that said members come to rest on the water surface adjacent the surface of said dock structure as said pier and dock structures move relative to one another.

3. A system in accordance with claim 1 wherein said pier is stationary and said dock structure moves relative to said first structure.

4. A system in accordance with claim 1 wherein the lengths of each of said ramp members are selected in accordance with said range of tidal motions to be less than a preselected value.

5. A system in accordance with claim 4 wherein the slopes of said ramp members are selected in accordance with said range of tidal motions so as not to exceed a preselected value during use.

6. A system in accordance with claim 1 wherein said alternating platform and ramp members are arranged so as to be effectively positioned in alignment with one another.

7. A system in accordance with claim 1 wherein said alternating platform and ramp members are arranged in a substantially folded configuration wherein one or more groups of one or more ramp and platform members are effectively positioned in a side-by-side relationship.

8. A system in accordance with claim 7 wherein each group includes at least two ramp members and one platform member and is hingedly coupled to an adjacent group via an intermediate platform member.

* * * * *

UNITED STATES PATENT AND TRADEMARK OFFICE

CERTIFICATE OF CORRECTION

PATENT NO. : 4,998,313

DATED : March 12, 1991

INVENTOR(S) : Lippka et al.

It is certified that error appears in the above-indentified patent and that said Letters Patent is hereby corrected as shown below:

Column 1, line 7, insert the following information:

--The Government has rights in this invention pursuant to Grant Number NA86AA-D-SG089 awarded by the Department of Commerce.--

Signed and Sealed this

Twenty-third Day of May, 1995

Bruce Lehman

*Attest:*

BRUCE LEHMAN

*Attesting Officer*

*Commissioner of Patents and Trademarks*